United States Patent [19]

Watanabe

[11] 4,392,503

[45] Jul. 12, 1983

[54] VANITY CASE

[75] Inventor: Nobuhisa Watanabe, Sekimachi, Japan

[73] Assignee: Yoshida Industry Co., Ltd., Tokyo, Japan

[21] Appl. No.: 375,953

[22] Filed: May 6, 1982

[51] Int. Cl.[3] ..... A45D 33/00

[52] U.S. Cl. ..... 132/83 R; 206/1.5

[58] Field of Search ..... 132/83 R, 82 R; 220/262–263; 401/126; 206/1.5

[56] References Cited

U.S. PATENT DOCUMENTS

| | | | |
|---|---|---|---|
| 2,460,444 | 2/1949 | Bering | 132/82 R |
| 3,828,899 | 8/1974 | Scott | 206/1.5 |
| 4,276,893 | 7/1981 | Enomoto | 132/83 R |
| 4,363,403 | 12/1982 | Raucci, Jr. | 206/1.5 |

*Primary Examiner*—G. E. McNeill

*Attorney, Agent, or Firm*—Wenderoth, Lind & Ponack

[57] ABSTRACT

A vanity case is provided in which an unlatch member is housed in a rectangular recess formed in either one of a receptacle member and a cover member and has its one end formed as a free end extending upwardly while the other end retained in the recess. The free end is arranged to lie closely adjacent to a marginal portion of the other member in a closed position of the cover and also arranged to move inwardly to apply such force as to separate the cover from the receptacle, thereby releasing the engagement of the latching members when the unlatch member is pushed inwardly.

5 Claims, 8 Drawing Figures

VANITY CASE

BACKGROUND OF THE INVENTION

The present invention relates to improvement of a vanity case, and more particularly to improvement of a latch-unlatch mechanism of a synthetic resin-made vanity case having a receptacle member and a cover member hinged with each other and arranged to be latched by snap engagement of an elastic latch tongue formed on one of the members with a protrusion on the other member.

In known vanity cases of the abovesaid type, the elastic latch tongue and the protrusion are formed integrally with the cover and receptacle members by plastic molding. The elastic tongue and the protrusion have to be formed very precisely in dimensions; otherwise, the vanity cases would accidentally open when unwanted due to the weakness of the engagement between the latch tongue and the protrusion, or if the engagement therebetween is too strong, a relatively large force has to be exerted to open the cover member, causing a trouble to the user. Accordingly, when molding the cover and receptacle members, the utmost attention has been paid to the accuracy of the dimensions of the latch tongue and the protrusion. However, quite a number of vanity cases are rejected as defective owing to improper engagement between the latch tongue and the protrusion.

With ordinary vanity cases heretofore employed, it is relatively troublesome to open the cover as the user usually pries open the front edge of the cover with the thumb of one hand while holding the front edge of the receptacle with the thumb of the other hand. And if the engagement between the latch tongue and the protrusion is unduly strong, a strong force has to be exerted to disengage them, often resulting in the contents of the case dropping out therefrom because of sudden opening of the case.

In order to provide an improved vanity case, it has been proposed to employ a slider element which serves as an unlatch member for disengaging the latch tongue from the protrusion. This proposal has successfully settled the above defects to the considerable extent. In such a vanity case, however, it is necessary to provide a cavity in either one of the receptacle or cover member for receiving the slider element, which inevitably makes above and below the cavity thin portions easy to break. Also, the slider element has been found not to operate so smoothly when it is not exactly fitted in the slender cavity.

Therefore, an object of the present invention is to provide a vanity case which is free from all the above defects and can easily be opened with a light tough thereon.

It is another object of the present invention to provide a vanity case which is very simple in structure and assembly, and is reliable in operation.

SUMMARY OF THE INVENTION

A vanity case according to the present invention comprises a receptacle member for containing a cosmetic material, a cover member hinged with the receptacle member at the rear end thereof, a first latching member integrally formed with the cover member, a second latching member integrally formed with the receptacle member for engagement with the first latching member by snap action when the receptacle member is closed by the cover member, and an unlatch member disposed in either one of the receptacle member and the cover member. The unlatch member is housed in a recess substantially of rectangle formed in a marginal portion of either one of the receptacle member and the cover member, and has its one end formed as a free end extending upwardly while the other end retained in the recess. The free end is arranged to lie closely adjacent to a marginal portion of the other of the receptacle member and the cover member in the closed position of the cover member and also arranged to move inwardly about the other end of the unlatch member to apply force in a direction in which to separate the cover member from the receptacle member, thereby releasing the engagement of between the first and second latching member when the unlatch member is pushed inwardly.

Preferably, the marginal portion, to which the free end of the unlatch member lies closely adjacent, is tapered.

Further objects and features of the present invention will become apparent from the detailed description of preferred embodiments thereof when taken in conjunction with the accompanying drawings, in which:

DETAILED DESCRIPTION OF THE INVENTION

Figure 1:
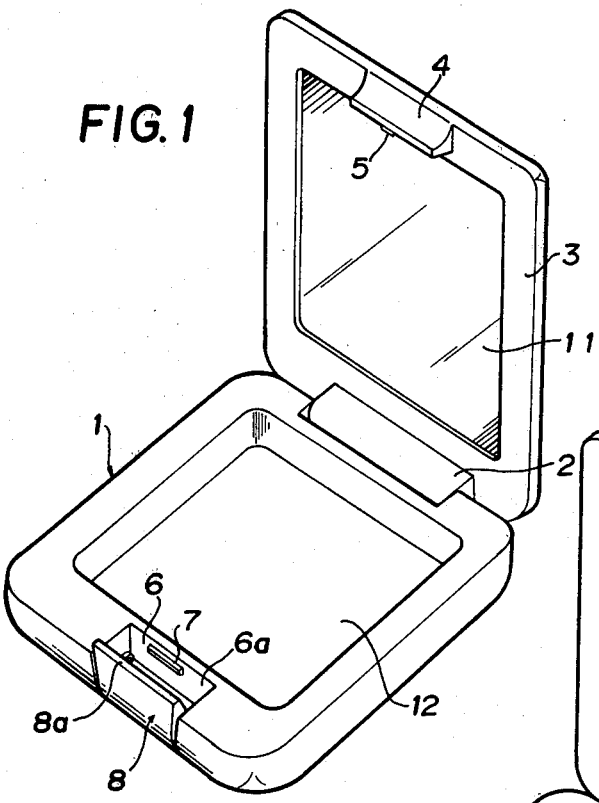
FIG. 1 is a perspective view illustrating a first embodiment of the vanity case of the present invention, with its cover member opened.
Figure 2:
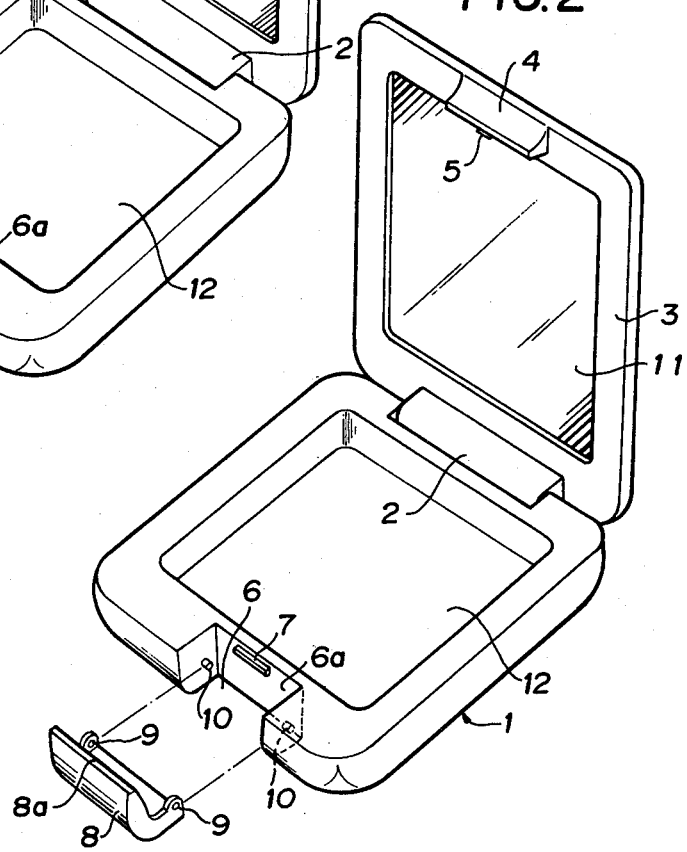
FIG. 2 is a perspective view of the vanity case, showing in exploded view an unlatch member before assembling thereof with its receptacle member.
Figure 3:
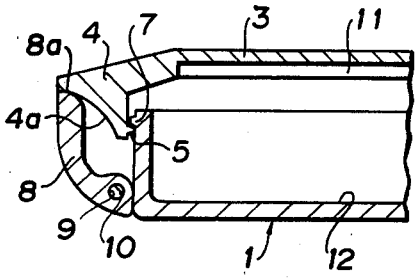
FIG. 3 is a sectional view showing the vanity case in its closed position.

Referring now to FIGS. 1 to 3 showing a vanity case or compact according to a first embodiment of the present invention, reference numeral 1 indicates a synthetic resin-made receptacle member, which is coupled at the rear end thereof with a cover member 3 by means of a hinge 2. The cover member 3 has a latch nose 4 formed integrally therewith to extend downwardly from the central portion of the front end thereof. Latch nose 4 has a latch tongue 5 on the inner surface thereof. A rectangular recess 6 is provided in the front end of the receptacle member 1 at a position corresponding to the latch nose 4. The end wall **6*a* defining the recess 6 has a protrusion 7 integrally formed therewith. When pressing down the cover member 3 to close the vanity case, the latch tongue 5 is snapped into engagement with the protrusion 7** to assume its latched position.

In the recess 6 there is disposed an unlatch member 8 which is arcuate in cross section. The unlatch member 8 has an upper end 8*a* forming a free end perpendicular to the plane of the receptacle member 1 while its lower end portion has both sides thereof drilled to form circular holes 9—9 for receiving bosses 10—10, projecting from either side of the recess 6 at the lower part thereof. The unlatch member 8 is formed separately of the receptacle member 1, and is assembled therewith by pushing it into the aforesaid recess 6 to engage the circular holes 9—9 with the projecting bosses 10—10. The unlatch member 8 thus assembled with the receptacle member 1 is pivotably turnable about the projecting bosses 10—10. Also, the free end 8*a* of the unlatch member 8 makes light contact with an outer tapered surface 4*a* of the latch nose 4 when the cover member 3 has been closed upon the receptacle member 1. The outer tapered surface 4*a* of the latch member 4 slopes down inwardly as shown in FIG. 3. Incidentally, reference numeral 11 designates a mirror, and 12 identifies a tray recessed into the receptacle member 1 for cosmetics.

Figure 4:
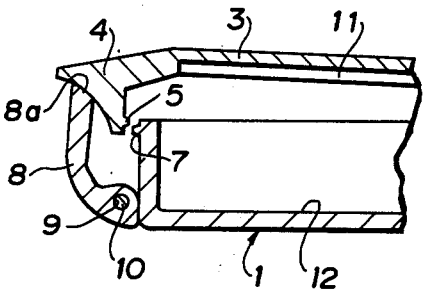
FIG. 4 is a sectional view showing the vanity case with the cover member partially opened by manipulating the unlatch member.

Pressing the unlatch member 8 towards the end wall 6*a* of the recess 6 in such a position as shown in FIG. 3 in which the vanity case of the abovesaid arrangement is closed, the unlatch member 8 pivots forwardly about the projecting bosses 10—10 fitted into the circular holes 9—9, as shown in FIG. 4. In consequence, the upper free end 8*a* of the unlatch member 8 slides on the outer tapered surface 4*a* of the latch nose 4 of the cover member 3 and pushes up the cover member 3 to disengage its latch tongue 5 from the protrusion 7 of the receptacle member 1, by which the cover member 3 is partially opened, permitting the user to set the mirror 11 at a desired angle.

As has been described in the foregoing, the unlatch member 8 is decently housed in the rectangular recess 6 and, by inwardly pressing the unlatch member 8, the cover member 3 can be opened, thus eliminating such an action as prying the cover member 3 open as in the past. Moreover, one end portion of the unlatch member 8 is attached to the receptacle member 1 and acts as a fulcrum and the other end portion 8*a* acts as a point of application, displaying the functional power of a lever, so that the cover member 3 can easily be opened by a small force.

Figure 5:
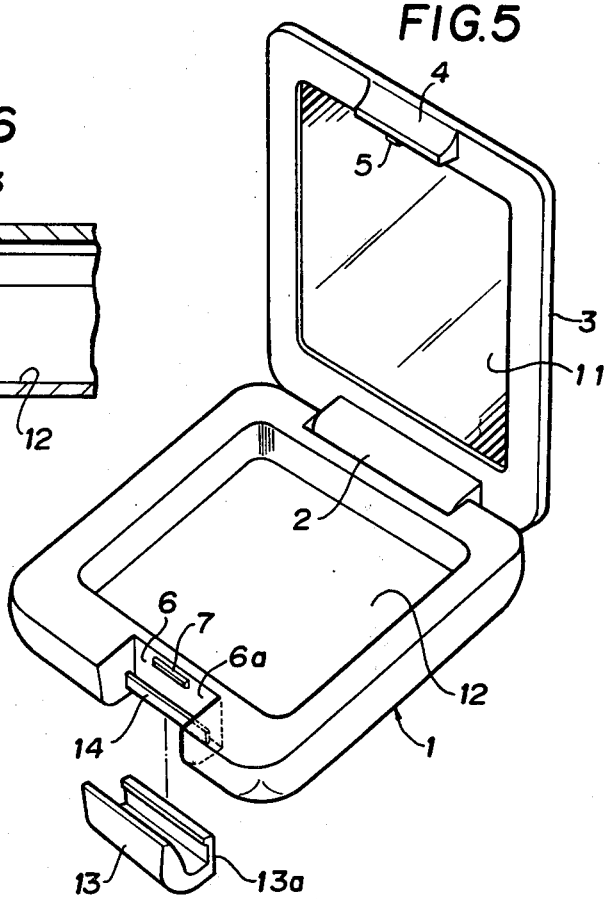
FIG. 5 is a perspective view of a second embodiment of the vanity case of the present invention, showing in exploded view its unlatch member before assembling thereof with its receptacle member.
Figure 6:
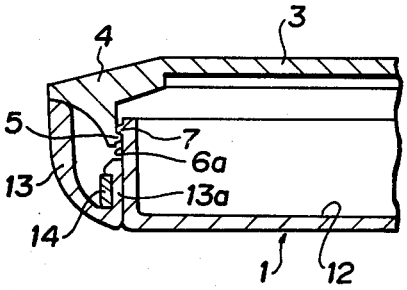
FIG. 6 is a sectional view of the vanity case of FIG. 5 with the unlatch member assembled with the receptacle member.

FIGS. 5 and 6 illustrates a second embodiment of the vanity case of the present invention. In this embodiment, a lower end portion 13*a* of the unlatch member 13, which has an upper free end portion similar to that in the first embodiment, is perpendicularly extended upwardly and is press-fitted from under the receptacle 1 into a gap defined between the end wall 6*a* of the rectangular recess 6 of the receptacle member 1 and a beam member 14 which is integrally formed with the both side walls of the recess 6 to extend thereacross. The unlatch member 13 in this embodiment is made of an elastic synthetic resin: therefore, when pressed toward the end wall 6*a* of the recess 6, the unlatch member 13 flexibly bends forwardly about the lower end portion of the beam member 14, and its upper free end pushes up the cover member 3 to open it as in the case of the first embodiment described above. As to the other recpects of structure, it is substantially analogous to those in the first embodiment.

It is to be noted here, however, that the second embodiment has such a further advantage that the unlatch member 13 automatically returns to its original position as shown in FIG. 6 due to its elasticity upon removal of the pressure applied thereto.

Figure 7:
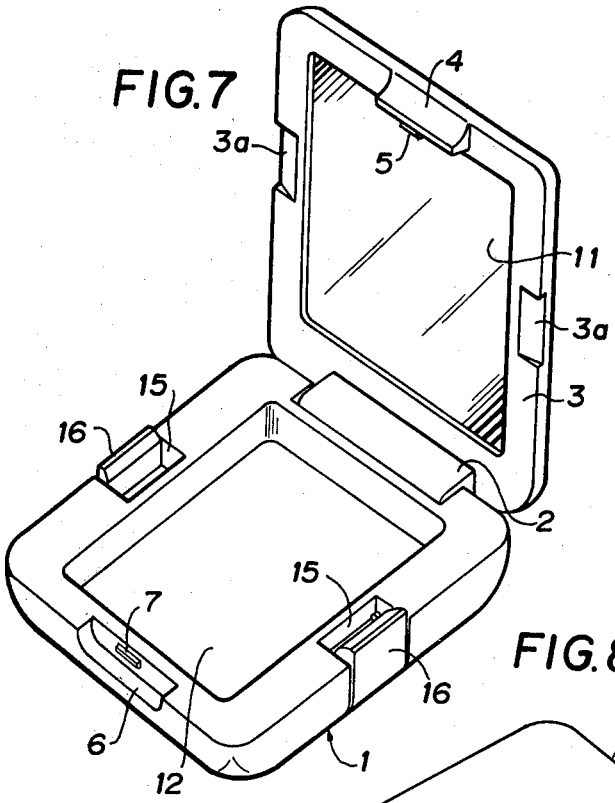
FIG. 7 is a perspective view illustrating a third embodiment of the present invention.
Figure 8:
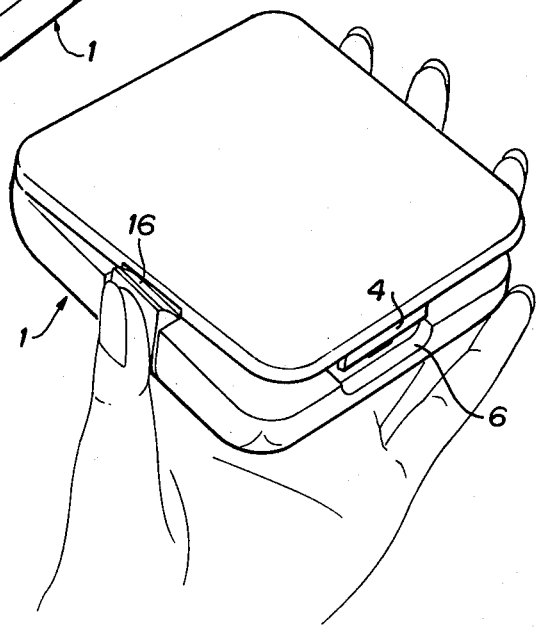
FIG. 8 is a perspective view showing a manner to open a cover member of the vanity case in FIG. 7.

FIG. 7 illustrates a third embodiment of the present invention, in which recesses 15—15 are formed in both side marginal portions of the receptacle member 1 centrally thereof and unlatch members 16—16 of the same arrangement as described above in respect of the first or second embodiment are each attached at the lower end portion thereof to the receptacle member 1 in the recess 15. Tapered surface portions 3*a*—3*a* are formed in both side marginal portions of the cover member 3 centrally thereof so that they may abut on the upper free ends of the unlatch members 16—16 when the cover member 3 has been pressed down onto the receptacle member 1. In this embodiment, no unlatch member is disposed in the recess 6 formed in the front end of the receptacle member 1 unlike in the first and second embodiments. With the arrangement of this embodiment, the cover member 3 can be opened simply by a one-hand operation consisting of pressing inwardly the outsides of the both unlatch members 16—16 by the thumb and the middle finger of the user's hand holding the compact case on the palm thereof, as shown in FIG. 8. In the other respects of structure and operation, this embodiment has little difference from the first and second embodiments.

Although the foregoing embodiments have been described in connection with the case where the unlatch member is installed in the recess formed in the receptacle member 1, the present invention is not limited specifically thereto but it is also possible to form the recess in the cover member in which to dispose the unlatch member.

It will be apparent that many modifications and variations may be effected without departing from the scope of the novel concepts of the present invention.

What is claimed is:

1. A synthetic resin-made vanity case comprising;

a receptacle member for containing a cosmetic material;

a cover member hinged with said receptacle member at the rear end thereof;

a first latching member integrally formed with said cover member;

a second latching member integrally formed with said receptacle member for engagement with said first latching member by snap action when said receptacle member is closed by said cover member; and an unlatch member disposed in either one of said receptacle member and said cover member;

wherein said unlatch member is housed in a recess substantially of rectangle formed in a marginal portion of either one of said cover member and said receptacle member; said unlatch member has its one end formed as a free end extending upwardly and the other end retained in said recess; and the free end of said unlatch member is arranged to lie closely adjacent to a marginal portion of the other of said receptacle member and said cover member in the position of said receptacle member being closed and also arranged to move inwardly about the other end of said unlatch member to apply force in a direction in which to separate said cover member from said receptacle member, thereby releasing the engagement of between said first and second latching member when said unlatch member is pushed inwardly.

2. A vanity case as claimed in claim 1, wherein said marginal portion to which said free end of said unlatch member lies closely adjacent is tapered.

3. A vanity case as claimed in claim 1, wherein said unlatch member is pivotably connected at the other end thereof to both side walls of said recess in a detachable manner and said free end of said unlatch member pivots inwardly about the other end when the unlatch member is pushed inwardly.

4. A vanity case as claimed in claim 1, wherein said unlatch member is made of an elastic synthetic resin and detachably mounted at the other end thereof on the end wall of said recess, said free end of said unlatch member flexibly bending inwardly when said unlatch member is pushed inwardly.

5. A vanity case as claimed in claim 1 or 2, wherein said recess is formed at each side marginal portion of either one of said receptacle member and the cover member.

* * * * *